United States Patent [19]

Trudell

[11] 4,116,303

[45] Sep. 26, 1978

[54] EXHAUST MUFFLER

[75] Inventor: Richard W. Trudell, Fountain Valley, Calif.

[73] Assignee: McDonnell Douglas Corporation, Long Beach, Calif.

[21] Appl. No.: 739,466

[22] Filed: Nov. 8, 1976

[51] Int. Cl.[2] ..... F01N 1/04; F01N 1/00

[52] U.S. Cl. ..... 181/252; 181/256; 181/272

[58] Field of Search ..... 181/255, 256, 252, 272, 181/249, 269

[56] References Cited

U.S. PATENT DOCUMENTS

| | | | |
|---|---|---|---|
| 2,166,417 | 7/1939 | Manning | 181/256 |
| 2,205,899 | 6/1940 | Chipley | 181/269 |

FOREIGN PATENT DOCUMENTS

| | | | |
|---|---|---|---|
| 487,400 | 11/1953 | Italy | 181/252 |
| 686,905 | 2/1953 | United Kingdom | 181/256 |

*Primary Examiner*—Stephen J. Tomsky
*Attorney, Agent, or Firm*—Max Geldin

[57] ABSTRACT

Exhaust muffler for sound suppression, particularly designed as an automotive muffler, which comprises a gas inlet tube communicating with a first chamber in an outer, preferably cylindrical, casing, and an exit tube coaxially aligned with the inlet tube within the casing, the inner end of the exit tube being spaced from the inlet tube and communicating with the first chamber. An imperforate boundary or baffle is positioned in the annulus between the outer wall of the exit tube and the inner wall of the outer casing, and intermediate the ends of the exit tube, the annular space to the rear of the baffle, between the exit tube and the casing, forming a second chamber which is filled with a sound absorber such as glass wool. The exit tube is perforated along the area thereof adjacent to the second chamber for fluid communication therewith. The muffler construction provides two expansion chambers in series, wherein the second chamber has the dual function of serving as the second expansion chamber to improve low frequency noise reduction and as a resistive absorber to improve middle and high frequency noise reduction.

22 Claims, 2 Drawing Figures

EXHAUST MUFFLER

BACKGROUND OF THE INVENTION

The present invention relates to a sound suppression system, particularly an exhaust muffler for automotive use, and is particularly directed to an automobile exhaust muffler of simple construction, which affords superior noise reduction over a wide frequency range with minimum pressure drop, while permitting good operating efficiency of the automobile.

In order to obtain suitable noise reduction, automotive exhaust systems and mufflers heretofore designed have been usually of complex construction, thus increasing their cost. Further, due to their tendency toward corrosion, such mufflers often require frequent replacement, thus increasing the cost of operation. Also, many such relatively complex muffler designs of the prior art result in an undesirably high pressure drop and increased back pressure, thus reducing the operating efficiency of the automobile.

Exemplary of the prior art muffler systems are those disclosed in U.S. Pat. Nos. 3,361,227; 3,672,464; 3,754,619; 3,842,932; and French Pat. No. 1,093,725.

It is accordingly an object of the present invention to provide a simple sound reduction system or muffler, particularly for automotive use, permitting high operating efficiency of the automobile.

A particular object is to provide a compact, low pressure drop, low cost muffler for vehicles, particularly internal combustion engines, providing sufficient sound reduction or suppression to meet present noise abatement laws.

SUMMARY OF THE INVENTION

The above objects are accomplished according to the present invention by the provision of an exhaust system or muffler, particularly designed and suited for use on automotive vehicles, comprised of a pair of expansion chambers of unequal volume, coupled by a tube whose length is chosen to eliminate undesirable resonances. The engine exhaust gases enter the exhaust muffler and expand into the first chamber, preferably having a volume greater than the second chamber. Reflection of the gases occurs at a boundary between the two chambers and the flow of gas enters an exit tube where the flow proceeds to the second chamber via perforations in such exit tube adjacent the second chamber region. The second chamber is filled with a sound absorber material such as glass wool, which is capable of withstanding the temperature and vibration associated with operation of the vehicle.

According to one embodiment, the sound reduction device or muffler of the invention comprises a preferably cylindrical casing having an inlet tube communicating with a first chamber within the casing, and an exit tube coaxially aligned with the inlet tube within the casing, the inner end of the exit tube being spaced from the inlet tube and communicating with the first chamber. An imperforate baffle or divider is positioned in the annulus between the outer wall of the exit tube and the inner wall of the outer casing, and intermediate the ends of the exit tube, the annular space to the rear of the baffle between the outer wall of the exit tube and the inner wall of the casing forming a second chamber which is filled with sound absorber material. This provides a pair of expansion chambers of unequal volume. The exit tube is perforated along the area thereof adjacent to the second chamber for communication of the exit tube with such second chamber.

The exhaust gases enter the muffler and are expanded in the first chamber, with reflection occurring at the imperforate baffle, and the gases then flow into the exit tube and through the perforations therein into the second chamber filled with the sound absorber material such as glass wool, and back into the exit tube for discharge therefrom.

The invention device accordingly provides two expansion chambers in series and wherein the second chamber serves a dual function, namely (1) as the second expansion chamber to improve low frequency noise reduction, and (2) as a resistive absorber to improve middle and high frequency noise reduction, thereby affording noise reduction over a wide frequency range.

The invention device permits a low pressure drop and low back pressure, thus permitting efficient operation of the engine, and is of a simple, compact low cost construction.

BRIEF DESCRIPTION OF THE DRAWING

The invention will be more fully understood by the description below of a preferred embodiment taken in connection with the accompanying drawing wherein.

DESCRIPTION OF THE PREFERRED EMBODIMENT

Figure 1:
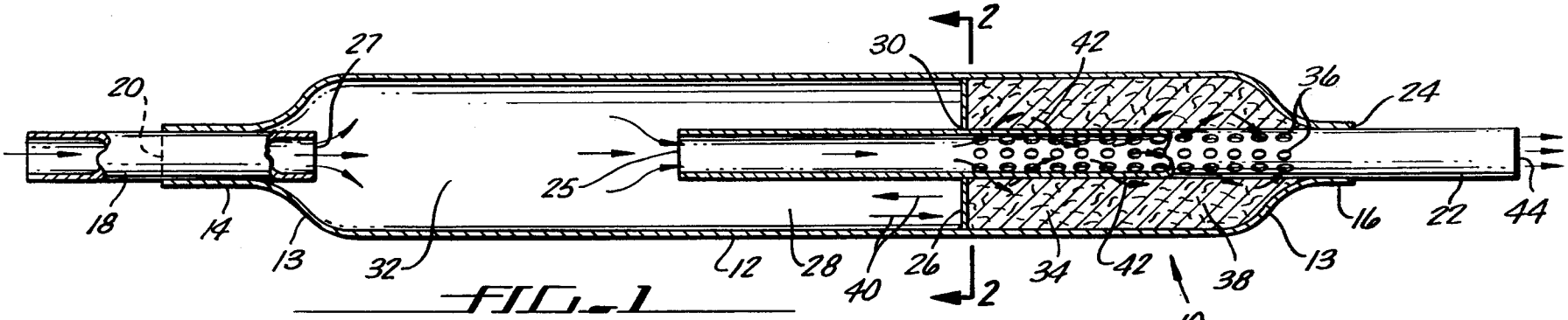
FIG. 1 is a longitudinal section of an exhaust muffler according to the invention.

Referring to the drawing, numeral 10 is an exhaust muffler according to the invention, comprised of an outer casing 12 of generally cylindrical configuration which is inwardly curved at its outer ends as indicated at 13, to provide cylindrical sleeves 14 and 16 of reduced diameter, forming an inlet and an outlet in coaxial alignment at the opposite inner and outer ends of the casing.

An inlet tube 18 is inserted into the inner sleeve 14 through its outer opening 20, the inlet tube 18 extending a short distance into the interior of the casing 12. An exit tube 22 is inserted through the open end 24 of the outer sleeve 16 and extends through such sleeve and for a substantial distance into the interior of the casing 12, in coaxial alignment with the inlet tube 18, the inlet and exit tubes 18 and 22 having the same diameter, which is substantially smaller than the diameter of the casing. The inlet and exit tubes 18 and 22 are press fitted into the sleeves 14 and 16, respectively. The inlet and exit tubes 18 and 22 are each open at their opposite ends, the inner end 25 of the exit tube 22 being positioned a substantial distance from the outer end 27 of the inlet tube 18.

It will be noted that the exit tube 22 is substantially greater in length than the inlet tube 18, and extends within the casing 12 for a distance of at least one half the interior length of the casing, the overall length of the exit tube 22 within the casing being about ⅓ of the overall length of the interior of casing 12 in the embodiment of FIG. 1. It has been found according to the invention that the overall length of the exit tube 22 within casing 12 should range generally from about 55% to about 75% of the overall length of the interior of casing 12. The length of the exit tube 22 is chosen so as to eliminate undesirable resonances.

An imperforate circular baffle or divider 26 is positioned in the annular space 28 between the outer wall of the exit tube 22 and the inner wall of the casing 12, such baffle having a central aperture 30 to receive the exit tube 22. The baffle 26 is positioned intermediate the ends of the exit tube 22, and in the preferred embodiment shown, the baffle 26 is located about half the distance between the ends of that portion of the exit tube 22 which is within the casing 12. However, the baffle 26 can be positioned at other locations intermediate the ends of the exit tube 22 within the casing 12.

The imperforate baffle 26 forms a first chamber 32 extending to the inner end of the casing 12, and communicating with the outer open end 27 of the inlet tube 18, and a second chamber 34 formed by the annular space to the rear of baffle 26, between the exit tube 22 and the casing 12, and extending from baffle plate 26 to the outer end of the casing 12. It will be noted that the chambers 32 and 34 are of unequal volume, the first chamber 32 extending from the inner end of the casing 12 to the baffle 26 being of substantially larger volume than the second chamber 34. It will also be noted that the baffle 26, in addition to forming the first and second chambers 32 and 34, also serves to support the exit tube 22 in axial position within the casing 12. The inner open end 25 of the tube 22 extends into the first chamber 32 and in communication therewith.

The exit tube 22 is perforated, as indicated at 36, along the area thereof adjacent to the second chamber 34, that is between the baffle 26 and almost to the outer end of the casing 12, to provide fluid communication between the exit tube 22 and the second chamber 34. The size of the perforations 36 can be chosen as desired to obtain maximum sound reduction with low fluid pressure drop through the device, the total area of the perforations 36 ranging from about 10% to about 30% of the total perforated area of the exit tube 22 adjacent the second chamber 34. The length of the perforated area of the exit tube 22 should range from about one half to about twice the length of the unperforated portion of the exit tube within casing 12. These respective lengths are chosen to provide the best compromise between low and high frequency attenuation. In the preferred embodiment shown in FIG. 1, the ratio of perforated to unperforated length of exit tube 22 within casing 12 is about 1 to 1.

Although in preferred practice the baffle 26 is positioned around the unperforated portion of the exit tube, in some cases the baffle can be positioned so that it is located intermediate the ends of the perforated portion of the exit tube, so that there are perforated portions of the exit tube on both sides of the baffle.

The second chamber 34 is filled with a suitable sound absorber material 38 such as glass wool, or other absorber material. A preferred sound absorber or muffler material is described in application Ser. No. 636,291, filed Nov. 28, 1975 of R. Gonzalez et al, assigned to the same assignee as the present application, and comprises an alumina-silica fiber matrix coated or impregnated with a silica binder, such muffler material having good sound absorption characteristics, high temperature and chemical resistance, and structural rigidity.

Exhaust gases entering through the inlet tube 18 expand into the first expansion chamber 32, the gases in chamber 32 being reflected from the baffle 26, back toward the center of the first expansion chamber 32, as indicated by the arrows 40. The gases in expansion chamber 32 enter the open inner end 25 of the exit tube 22 and flow into and out of the second chamber 34 containing the absorber material, through the apertures 36, as indicated by the arrows 42. The exhaust gases finally exit through the outer end 44 of exit tube 22.

The above described device provides a combination reactive-resistive muffler in a tubular envelope, which affords superior noise reduction with minimum pressure drop. The invention device, e.g. as described above, embodies a pair of unequal expansion chambers which are in series. The first expansion chamber provides enhanced low frequency noise reduction. The second chamber acts both as an expansion chamber to improve low frequency noise reduction and as an absorption chamber and resistive absorber to improve middle and high frequency noise reduction or attenuation.

The muffler of the present invention can be employed on any vehicle powered by an internal combustion engine, and hence the term "automotive" vehicle as used herein is intended to denote any such vehicle including autos, trucks, boats, etc.

Figure 2:
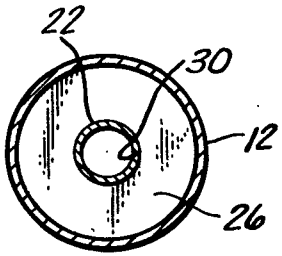
FIG. 2 is a transverse section taken on line 2—2 of FIG. 1.

It is seen that the invention device is of simple, compact construction and can be fabricated at low cost. It will be understood that structural modifications of the muffler device described in FIGS. 1 and 2 can be made within the scope of the invention. Thus, for example, although in preferred practice the first chamber 32 has a greater volume than the second chamber 34, in some instances the volume of both chambers can be substantially equal. Also, if desired, the inlet tube 18 can be omitted, and the exhaust gases introduced into the first chamber 32 via the inlet or sleeve 14. Further, although the outer casing is preferably of generally cylindrical shape, the casing can have other shapes, such as a square or rectangular or polygonal cross section. Similarly, the inlet and exit tubes 18 and 22 can have a cross section other than circular, such as a square or rectangular shape.

The following table compares the performance of the muffler design of FIG. 1 of the present invention employing the above alumina-silica fiber matrix coated with silica binder as sound absorber material, with two commercial mufflers, indicated A and B in the table below, and a test "glass pack" type muffler, the latter being in the form of a casing similar to casing 12 of FIG. 1, but with a single perforated tube extending completely through the casing, the annulus between the perforated tube and the casing being filled throughout with the same alumina-silica sound absorber material noted above. The figures in the table except for the last two columns on the right indicate sound pressure level in db (decibels referenced to 20 microNewtons per square meter) and the figures in the second column from the right represent the A weighted sound pressure level in db, as previously referenced.

TABLE

| | OCTAVE BAND CENTER FREQUENCY (cycles/sec) | | | | | | | | | INLET GAGE PRESSURE |
|---|---|---|---|---|---|---|---|---|---|---|
| MUFFLER TYPE | 63 | 125 | 250 | 500 | 1000 | 2000 | 4000 | 8000 | dbA | (in. Hg) |
| Brand A | 92 | 108.5 | 100 | 91.5 | 86 | 82 | 81.5 | 72.2 | 97 | 14.5 |

TABLE-continued

| MUFFLER TYPE | OCTAVE BAND CENTER FREQUENCY (cycles/sec) 63 | 125 | 250 | 500 | 1000 | 2000 | 4000 | 8000 | dbA | INLET GAGE PRESSURE (in. Hg) |
|---|---|---|---|---|---|---|---|---|---|---|
| Brand B | 90 | 106.5 | 95 | 84 | 80 | 75 | 74 | 72 | 91.5 | 24 |
| Test Glasspack | 94 | 110.5 | 100.5 | 89 | 82 | 76 | 72 | 68 | 96 | 5 |
| FIG. 1 Design | 92 | 107 | 96 | 87 | 83 | 76 | 73 | 68 | 92.5 | 6.9 |

It is seen from the last two columns to the right in the above table that the muffler design of FIG. 1 of the present invention produces the best combination of minimum noise (92.5 dbA) and minimum back pressure (6.9 in. Hg) as compared to the other three muffler designs tested, it being recognized that only an A weighted sound pressure level of 95 db or less is acceptable under present legal noise standards. Thus, although Brand B had a lower dbA of 91.5, it had a high back pressure of 24 in. Hg, and while the test glasspack had a lower back pressure of 5 in. Hg., it also had an unacceptable high dbA of 96.

While I have described particular embodiments of my invention for purposes of illustration, it is understood that other modifications and variations will occur to those skilled in the art, and the invention accordingly is not to be taken as limited except by the scope of the appended claims.

What is claimed is:

1. A muffler comprising a casing, an inlet to said casing and an outlet from said casing, an elongated exit tube passing through said outlet and extending within said casing for a distance of at least one half the interior length of said casing, said exit tube being coaxially aligned with said inlet, baffle means positioned in the annulus between the outer wall of said exit tube and the inner wall of said casing, and intermediate the ends of said exit tube, forming a first chamber extending from said baffle means to the inlet end of said casing and communicating with said inlet, and a second chamber provided by the annular space between the outer wall of said exit tube and the inner wall of said casing and extending from said baffle means to the outlet end of said casing, the inner end of said exit tube extending into said first chamber and in communication therewith, said exit tube being perforated along the area thereof adjacent to said second chamber, and sound absorber material filling said second chamber.

2. A muffler as defined in claim 1, including an inlet tube positioned within said inlet and extending into said casing in coaxial alignment with said exit tube, the inner end of said exit tube being spaced from the outer end of said inlet tube.

3. A muffler as defined in claim 2, said inlet tube extending a short distance into the interior of said casing, the inner end of said exit tube being positioned a substantial distance from the outer end of said inlet tube.

4. A muffler as defined in claim 1, the overall length of said exit tube within said casing ranging from about 55% to about 75% of the overall length of the interior of said casing.

5. A muffler as defined in claim 3, the overall length of said exit tube within said casing ranging from about 55% to about 75% of the overall length of the interior of said casing.

6. A muffler as defined in claim 1, the length of the perforated area of said exit tube ranging from about one half to about twice the length of the unperforated portion of the exit tube within said casing.

7. A muffler as defined in claim 1, said baffle means forming said first and second chambers being an imperforate baffle.

8. A muffler as defined in claim 5, said baffle means forming said first and second chambers being an imperforate baffle.

9. A muffler as defined in claim 1, said sound absorber material being glass wool.

10. A muffler as defined in claim 1, said first chamber being of substantially larger volume than said second chamber.

11. A muffler as defined in claim 1, said sound absorber material being an alumina-silica fiber material coated with a silica binder.

12. A muffler particularly suited for use on automotive vehicles, comprising a casing, an inlet to said casing at one end thereof and an outlet from said casing at the opposite end thereof, an inlet tube passing through said inlet and extending a short distance into said casing, an elongated exit tube passing through said outlet and extending within said casing for a distance of at least one half the interior length of said casing, an imperforate baffle positioned in the annulus between the outer wall of said exit tube and the inner wall of said casing, and intermediate the ends of said exit tube, forming a first chamber extending to the inlet end of said casing and communicating with the outer end of said inlet tube, and a second chamber provided by the annular space between the outer wall of said exit tube and the inner wall of said casing, and extending to the outlet end of said casing, the inner end of said exit tube extending into said first chamber and in communication therewith, the inner end of said exit tube being positioned a substantial distance from the outer end of said inlet tube, perforations in said exit tube extending along the area thereof adjacent to said second chamber and extending approximately from said baffle to said opposite end of said casing adjacent said outlet therefrom, and sound absorber material filling said second chamber.

13. A muffler as defined in claim 12, said inlet to and said outlet from said casing being in the form of sleeves extending from opposite ends of said casing, said inlet tube and said exit tube being positioned within said respective sleeves, and said inlet and exit tubes having substantially the same diameter.

14. A muffler as defined in claim 12, said casing being substantially cylindrical and having a diameter substantially larger than the diameter of said inlet and exit tubes.

15. A muffler as defined in claim 12, the overall length of said exit tube within said casing ranging from about 55% to about 75% of the overall length of the interior of said casing.

16. A muffler as defined in claim 12, the total area of said perforations ranging from about 10% to about 30% of the total perforated area of said exit tube adjacent to said second chamber.

17. A muffler as defined in claim 12, the length of the perforated area of said exit tube ranging from about one half to about twice the length of the unperforated portion of the exit tube within said casing.

18. A muffler as defined in claim 12, said sound absorber material being glass wool.

19. A muffler as defined in claim 13, said casing being substantially cylindrical and having a diameter substantially larger than the diameter of said inlet and exit tubes, the overall length of said exit tube within said casing ranging from about 55% to about 75% of the overall length of the interior of said casing, the total area of said perforations ranging from about 10% to about 30% of the total perforated area of said exit tube adjacent to said second chamber, the length of the perforated area of said exit tube ranging from about one half to about twice the length of unperforated portion of the exit tube within said casing.

20. A muffler as defined in claim 19, said sound absorber material being an alumina-silica fiber matrix coated with a silica binder.

21. A muffler as defined in claim 12, said first chamber being of substantially larger volume than said second chamber.

22. A muffler as defined in claim 12, said sound absorber material being an alumina-silica fiber material coated with a silica binder.

* * * * *